US011401586B2

(12) United States Patent
Fu et al.

(10) Patent No.: US 11,401,586 B2
(45) Date of Patent: Aug. 2, 2022

(54) HIGH-STRENGTH A356 ALLOY AND PREPARATION METHOD THEREOF

(71) Applicant: CITIC Dicastal CO., LTD., Hebei (CN)

(72) Inventors: Shoujun Fu, Qinhuangdao (CN); Jinwei Liu, Qinhuangdao (CN); Chunwei Wang, Qinhuangdao (CN); Haichao Sun, Qinhuangdao (CN); Huiying Liu, Qinhuangdao (CN)

(73) Assignee: CITIC DICASTAL CO., LTD., Hebei (CN)

( * ) Notice: Subject to any disclaimer, the term of this patent is extended or adjusted under 35 U.S.C. 154(b) by 261 days.

(21) Appl. No.: 16/693,896

(22) Filed: Nov. 25, 2019

(65) Prior Publication Data

US 2020/0299810 A1 Sep. 24, 2020

(30) Foreign Application Priority Data

Mar. 22, 2019 (CN) ..... 201910220737.7

(51) Int. Cl.

| | |
|---|---|
| ***C22F 1/04*** | (2006.01) |
| ***C22C 21/04*** | (2006.01) |
| ***C22F 1/043*** | (2006.01) |

(52) U.S. Cl.

CPC ..... *C22C 21/04* (2013.01); *C22F 1/043* (2013.01)

(58) Field of Classification Search

CPC ..... C22C 21/04; C22F 1/043

See application file for complete search history.

(56) References Cited

FOREIGN PATENT DOCUMENTS

| | | | |
|---|---|---|---|
| CN | 103866166 | A | 6/2014 |
| CN | 106048334 | A | 10/2016 |
| CN | 106591638 | A | 4/2017 |
| CN | 108588513 | A | 9/2018 |
| CN | 109207809 | A | 1/2019 |
| DE | 69606060 | T2 | 9/2000 |
| EP | 0859868 | A1 | 8/1998 |
| KR | 20150071511 | A | 6/2015 |

OTHER PUBLICATIONS

"Corrosion performance of high pressure die-cast Al—6Si—3Ni and Al—6Si—3Ni—2Cu alloys in aqueous NaCl solution"; 2018; Srinivasan Arthanari, Jae Heol Jang and Kwang Seon Shin;Transactions of Nonferrous Metals Society of China, pp. 2181-2189.

"Extension and Development of A356 Alloy" Mar. 2014; Xiong Yi, Resource regeneration, 5 pgs.

*Primary Examiner* — Jessee R Roe

(74) *Attorney, Agent, or Firm* — Cooper Legal Group, LLC

(57) ABSTRACT

A high-strength A356 alloy and a preparation method thereof are disclosed. Modifiers Ba and Zr are added to improve the as-cast structure of the alloy. The high-pressure solidified A356 alloy prepared by a high-pressure solidification technology has finer grains, and the elements such as Mg and Si have higher supersaturated solubility in a matrix.

2 Claims, No Drawings

HIGH-STRENGTH A356 ALLOY AND PREPARATION METHOD THEREOF

CROSS-REFERENCE TO RELATED APPLICATIONS

The present application claims benefit of Chinese Application No. 201910220737.7, filed on Mar. 22, 2019, the contents of which are hereby incorporated by reference in their entirety.

BACKGROUND

An aluminum alloy has the characteristics of high strength and hardness, good machinability and castability, excellent shock absorption and heat dissipation property, high recycling property, good corrosion resistance and the like. It is widely used in the fields of automobiles, aviations, aerospace, electronic products and the like.

A356 alloy (the brand name in China is ZL101) belongs to cast Al—Si alloy, which not only has good casting property, but also can be used for casting thin-wall or complex-shaped castings, so it is widely used in automotive aluminum alloy hubs. However, since a primary α-Al phase in the as-cast A356 alloy has a coarse structure and dendritic segregation, a needle-like eutectic Si phase cuts a matrix easily, and the comprehensive mechanical properties often fail to meet actual production requirements.

In order to further improve the mechanical properties of the A356 alloy, modification, alloying and thermal treatment processes are often used to eliminate the dendritic segregation and a needle-like structure in the structure, and to enhance the tensile strength of the alloy and remove the internal stress of the alloy at the same time. For example, CN 108588513 A discloses a modified A356 aluminum alloy in which grain refinement and modification are realized by adding trace elements Zr and Sr. The modified A356 aluminum alloy is prepared from the following components in percentage by weight: 6.5 to 7.5 percent of Si, 0.25 to 0.30 percent of Mg, 0.10 to 0.50 percent of Ti, 0.10 to 0.50 percent of Zr, 0.02 to 0.20 percent of Sr and the balance of Al. After aging and thermal treatment are performed for multiple times, the maximum tensile strength is 319 MPa, the maximum elongation is 12 percent, and the Brinell hardness is up to 105 HBW. CN 103866166 A discloses an aluminum alloy. Modifiers Te and Sb and rare earth elements La, Ce, Hf and Y are added on the basis of a traditional ZL101 aluminum alloy composition, and the alloy has maximum tensile strength of 300 MPa and maximum elongation of 18 percent after T6 treatment.

Although the above methods have improved the mechanical properties of the A356 alloy, the effect is still not satisfactory, and the introduction of precious metal elements (such as La, Ce, Y, etc.) also increases the cost of the alloy to a certain extent. At present, a single strengthening method can no longer meet the performance requirements of industrial production for the A356 alloy, and integrated utilization of various strengthening methods for composite strengthening is considered to be an effective method for developing a low-cost high-performance aluminum alloy.

SUMMARY

The present disclosure relates to a high-strength A356 alloy and a preparation method, and belongs to the technical field of metallic materials engineering.

In view of the shortcomings in the prior art, the present disclosure prepares a novel low-cost high-strength A356 alloy by methods such as modification, solid solution strengthening, refinement strengthening and second-phase strengthening. (1) An element Ba is added as a modifier on the basis of a traditional cast A356 alloy to suppress the growth speed of a eutectic Si phase and improve the shape of the eutectic Si phase. (2) By adding of the element Zr, on one hand, cast alloy grains are refined, and damage of other impurity elements to the structure and performance of the alloy is reduced; and on the other hand, Zr may serve as a modifier in a subsequent aging treatment process to improve the shape of a strengthening phase β'-Mg2Si to enable the strengthening phase to turn from a rodlike shape or a needle-like shape into a spherical shape. (3) The solidification structure of the A356 alloy is further refined by a high-pressure solidification technology to improve the forms and distributions of a primary α-Al phase and the eutectic Si phase.

The present disclosure adopts the following technical solution.

A high-strength A356 alloy is prepared from the following components in percentage by mass: 6.5 to 7.5 percent of Si, 0.3 to 0.5 percent of Mg, 0.05 to 0.1 percent of Cu, 0.05 to 0.2 percent of Ti, 0.1 to 0.5 percent of Ba, 0.5 to 1.5 percent of Zr, less than or equal to 0.15 percent of impurity elements and the balance of Al.

In an embodiment, the mass percentages of the above components of the alloy are in the following ranges: 7 percent of Si, 0.35 percent of Mg, 0.05 percent of Cu, 0.08 percent of Ti, 0.3 percent of Ba, 0.6 percent of Zr, less than or equal to 0.15 percent of impurity elements and the balance of Al.

A preparation method of the high-strength A356 alloy includes the following steps:

(1) taking an A356 aluminum ingot, a pure Mg ingot, an Al—Ba intermediate alloy and an Al—Zr intermediate alloy as raw materials, and calculating desired mass percentages of the various raw materials according to components of the target alloy;

(2) preheating the raw materials in Step (1) at 300 DEG C.;

(3) setting heating temperature of a crucible resistance furnace as 720 to 780 DEG C.; adding the A356 aluminum ingot when the temperature of the crucible reaches 300 to 350 DEG C.; adding the Al—Ba intermediate alloy and the Al—Zr intermediate alloy in sequence when the A356 aluminum ingot is completely melted and the temperature of the crucible reaches 600 to 650 DEG C.; adding a $C_2Cl_6$ refining agent after the raw materials are completely melted, and slightly stirring the mixture; removing dross from the surface of a melt when the temperature of the furnace reaches 720 to 780 DEG C.; preserving the heat for 15 to 30 min, and then pouring the metal melt into a preheated metal mold to obtain a desired A356 as-cast alloy;

(4) machining the A356 as-cast alloy obtained in Step (3) into a test sample used at high pressure, and putting the test sample into a high-pressure 6-surface diamond presser for high-pressure solidification: setting solidification pressure as 2 to 5 GPa, turning on a temperature measurement device at the same time, fast heating the test sample to 750 to 850 DEG C.; preserving the heat and the pressure at this temperature for 15 to 20 min, turning off a power supply to stop heating, performing pressure relief after the test sample is cooled to room temperature, and taking out the test sample to obtain a further refined high-pressure solidified A356 alloy;

(5) aging the high-pressure solidified A356 alloy obtained in Step (4) at 150 to 200 DEG C. for 2 to 100 h to finally obtain the high-strength A356 alloy.

In the above-mentioned step (1), selection of the Al—Ba intermediate alloy and the Al—Zr intermediate alloy as the raw materials may effectively avoid excessive burning of Ba and Zr in alloy smelting.

In the above-mentioned step (2), the various smelting raw materials are fully preheated before being put into the crucible to prevent explosion caused by moisture contained in the raw materials.

In the above-mentioned step (3), by the adoption of the metal mold to cast the alloy, the cooling of the alloy melt is accelerated by use of the characteristic of fast heat transfer of a metal, thereby obtaining the A356 with a finer structure.

In the above-mentioned step (4), compared with a 2-surface diamond presser system, the high-pressure 6-surface diamond presser used for the high-pressure solidification experiment saves one prestress mold and one large-sized stand, and a pressure field in a high-pressure cavity is more ideal.

In the above-mentioned step (4), before the heating temperature is set, liquidus temperature of each test sample under the action of high pressure at a GPa level needs to be tested. According to the Clausius-Clapeyren equation, the melting point of a substance varying with pressure is affected by a volume change during solid-liquid phase change. Since a melting process of Al under the action of the high pressure is expansion reaction, the melting point of Al rises as the pressure increases.

Compared with the prior art, the present disclosure has the following advantages.

1. A single strengthening method can no longer meet the performance requirements of industrial production for the A356 alloy. In the present disclosure: (1) the modifiers Ba and Zr are added to improve the as-cast structure of the alloy; (2) the high-pressure solidified A356 alloy prepared by the high-pressure solidification technology has finer grains, and the elements such as Mg and Si have higher supersaturated solubility in a matrix; and (3) the strength of the high-pressure solidified A356 alloy is further enhanced through aging strengthening. Strengthening methods include modification, solid solution strengthening, refinement strengthening and second-phase strengthening.

2. The A356 alloy prepared by the method has the maximum compressive strength of 371 Mpa and the maximum elongation of 12.7 percent.

DETAILED DESCRIPTION

The present disclosure is further described below in combination with specific implementation modes, but the content of the present disclosure is not limited to the following embodiments.

First Embodiment

A high-strength A356 alloy and a preparation method thereof are provided. The high-strength A356 alloy is prepared from the following components in percentage by mass: 7 percent of Si, 0.3 percent of Mg, 0.06 percent of Cu, 0.1 percent of Ti, 0.2 percent of Ba, 0.5 percent of Zr, less than or equal to 0.15 percent of impurity elements and the balance of Al.

The preparation method of the high-strength A356 alloy is as follows:

(1) an A356 aluminum ingot, a pure Mg ingot, an Al—Ba intermediate alloy and an Al—Zr intermediate alloy are taken as raw materials, and desired mass percentages of the various raw materials are calculated according to components of the target alloy;

(2) the raw materials in Step (1) are preheated at 300 DEG C.;

(3) heating temperature of a crucible resistance furnace is set as 740 DEG C.; the A356 aluminum ingot is added when the temperature of the crucible reaches 300 DEG C.; the Al—Ba intermediate alloy and the Al—Zr intermediate alloy are added in sequence when the A356 aluminum ingot is completely melted and the temperature of the crucible reaches 650 DEG C.; a $C_2Cl_6$ refining agent is added after the raw materials are completely melted, and the mixture is slightly stirred; dross is removed from the surface of a melt when the temperature of the furnace reaches 740 DEG C., the heat is preserved for 15 min, and then the metal melt is poured into a preheated metal mold to obtain a desired A356 as-cast alloy;

(4) the A356 as-cast alloy obtained in Step (3) is machined into a test sample used at high pressure and then the test sample is put into a high-pressure 6-surface diamond presser for high-pressure solidification: solidification pressure is set as 2 GPa, and a temperature measurement device is turned on at the same time; the test sample is fast heated to 770 DEG C.; the heat and the pressure are preserved at this temperature for 15 min; a power supply is turned off to stop heating; pressure relief is performed after the test sample is cooled to room temperature; and the test sample is taken out to obtain a further refined high-pressure solidified A356 alloy;

(5) the high-pressure solidified A356 alloy obtained in Step (4) is aged at 180 DEG C. for 8 h to finally obtain the high-strength A356 alloy.

Second Embodiment

A high-strength A356 alloy and a preparation method thereof are provided. The high-strength A356 alloy is prepared from the following components in percentage by mass: 6.5 percent of Si, 0.4 percent of Mg, 0.06 percent of Cu, 0.1 percent of Ti, 0.4 percent of Ba, 0.7 percent of Zr, less than or equal to 0.15 percent of impurity elements and the balance of Al.

The preparation method of the high-strength A356 alloy is as follows:

(1) an A356 aluminum ingot, a pure Mg ingot, an Al—Ba intermediate alloy and an Al—Zr intermediate alloy are taken as raw materials, and desired mass percentages of the various raw materials are calculated according to components of the target alloy;

(2) the raw materials in Step (1) are preheated at 300 DEG C.;

(3) heating temperature of a crucible resistance furnace is set as 750 DEG C.; the A356 aluminum ingot is added when the temperature of the crucible reaches 300 DEG C.; the Al—Ba intermediate alloy and the Al—Zr intermediate alloy are added in sequence when the A356 aluminum ingot is completely melted and the temperature of the crucible reaches 640 DEG C.; a $C_2Cl_6$ refining agent is added after the raw materials are completely melted, and the mixture is slightly stirred; dross is removed from the surface of a melt when the temperature of the furnace reaches 750 DEG C., the heat is preserved for 20 min, and then the metal melt is poured into a preheated metal mold to obtain a desired A356 as-cast alloy;

(4) the A356 as-cast alloy obtained in Step (3) is machined into a test sample used at high pressure and then the test sample is put into a high-pressure 6-surface diamond presser for high-pressure solidification: solidification pressure is set as 3 GPa, and a temperature measurement device is turned on at the same time; the test sample is fast heated to 800 DEG C.; the heat and the pressure are preserved at this temperature for 15 min; a power supply is turned off to stop heating; pressure relief is performed after the test sample is cooled to room temperature; and the test sample is taken out to obtain a further refined high-pressure solidified A356 alloy;

(5) the high-pressure solidified A356 alloy obtained in Step (4) is aged at 150 DEG C. for 10 h to finally obtain the high-strength A356 alloy.

Third Embodiment

A high-strength A356 alloy and a preparation method thereof are provided. The high-strength A356 alloy is prepared from the following components in percentage by mass: 7 percent of Si, 0.35 percent of Mg, 0.05 percent of Cu, 0.08 percent of Ti, 0.3 percent of Ba, 0.6 percent of Zr, less than or equal to 0.15 percent of impurity elements and the balance of Al.

The preparation method of the high-strength A356 alloy is as follows:

(1) an A356 aluminum ingot, a pure Mg ingot, an Al—Ba intermediate alloy and an Al—Zr intermediate alloy are taken as raw materials, and desired mass percentages of the various raw materials are calculated according to components of the target alloy;

(2) the raw materials in Step (1) are preheated at 300 DEG C.;

(3) heating temperature of a crucible resistance furnace is set as 730 DEG C.; the A356 aluminum ingot is added when the temperature of the crucible reaches 350 DEG C.; the Al—Ba intermediate alloy and the Al—Zr intermediate alloy are added in sequence when the A356 aluminum ingot is completely melted and the temperature of the crucible reaches 620 DEG C.; a $C_2Cl_6$ refining agent is added after the raw materials are completely melted, and the mixture is slightly stirred; dross is removed from the surface of a melt when the temperature of the furnace reaches 730 DEG C., the heat is preserved for 20 min, and then the metal melt is poured into a preheated metal mold to obtain a desired A356 as-cast alloy;

(4) the A356 as-cast alloy obtained in Step (3) is machined into a test sample used at high pressure and then the test sample is put into a high-pressure 6-surface diamond presser for high-pressure solidification: solidification pressure is set as 4 GPa, and a temperature measurement device is turned on at the same time; the test sample is fast heated to 840 DEG C.; the heat and the pressure are preserved at this temperature for 20 min; a power supply is turned off to stop heating; pressure relief is performed after the test sample is cooled to room temperature; and the test sample is taken out to obtain a further refined high-pressure solidified A356 alloy;

(5) the high-pressure solidified A356 alloy obtained in Step (4) is aged at 150 DEG C. for 10 h to finally obtain the high-strength A356 alloy.

Performance Comparison

The room-temperature tensile properties of the A356 alloys with different components in the above embodiments are described in the following table. The first comparative alloy is the modified A356 aluminum alloy prepared in CN 108588513 A. The second comparative alloy is the ZL101 aluminum alloy prepared in CN 103866166 A. The first to third embodiments use the high-strength A356 alloy obtained by the technology of the present disclosure.

| Comparative alloy | Component (mass percentage) | Tensile strength (MPa) | Elongation (%) |
|---|---|---|---|
| First comparative alloy | Al—7.0Si—0.3Mg—0.15Ti—0.3Zr—0.06Sr | 319 | 12 |
| Second comparative alloy | ZL01 + 0.1% Te | 300 | 12 |
| First embodiment | Al—7Si—0.3Mg—0.06Cu—0.1Ti—0.2Ba—0.5Zr | 326 | 12.7 |
| Second embodiment | Al—6.5Si—0.4Mg—0.06Cu—0.1Ti—0.4Ba—0.7Zr | 349 | 11.3 |
| Third embodiment | Al—7Si—0.35Mg—0.05Cu—0.08Ti—0.3Ba—0.6r | 371 | 10.6 |

It can be seen from the above table that the high-strength alloy prepared in the present disclosure by the integrated utilization of the methods such as modification, solid solution strengthening, refinement strengthening and second-phase strengthening has the maximum tensile strength of 371 Mpa and the maximum elongation of 12.7 percent.

The strength of the high-strength alloy is obviously higher than that of the first and second comparative alloys.

The invention claimed is:

1. A preparation method of an A356 alloy, the A356 alloy being prepared from the following components in percentage by mass: 6.5 to 7.5 percent of Si, 0.3 to 0.5 percent of Mg, 0.05 to 0.1 percent of Cu, 0.05 to 0.2 percent of Ti, 0.1 to 0.5 percent of Ba, 0.5 to 1.5 percent of Zr, less than or equal to 0.15 percent of impurity elements and a balance Al, wherein the preparation method comprises the following steps:

(1) taking an A356 aluminum ingot, a pure Mg ingot, an Al-Ba intermediate alloy and an Al-Zr intermediate alloy as raw materials, and calculating desired mass of each of the raw materials according to components of a target alloy;

(2) preheating the raw materials in Step (1) at 300 DEG C;

(3) setting heating temperature of a crucible resistance furnace as 720 to 780 DEG C; adding the A356 aluminum ingot when a temperature of a crucible reaches 300 to 350 DEG C; adding the Al-Ba intermediate alloy and the Al-Zr intermediate alloy in sequence when the A356 aluminum ingot is completely melted and the temperature of the crucible reaches 600 to 650 DEG C; adding a $C_2Cl_6$ refining agent after the raw materials are completely melted, and slightly stirring the mixture; removing dross from a surface of a metal melt when the temperature of the crucible resistance furnace reaches 720 to 780 DEG C, preserving the heat for 15 to 30 min, and then pouring the metal melt into a preheated metal mold to obtain a desired A356 as-cast alloy;

(4) performing high-pressure solidification on the A356 as-cast alloy obtained in Step (3): setting solidification pressure as 2 to 5 GPa, at the same time, heating the A356 as-cast alloy to 750 to 850 DEG C, preserving the heat and the pressure at this temperature for 15 to 20 min, turning off a power supply to stop heating, performing pressure relief after the A356 as-cast alloy is cooled to room temperature, and taking out the A356 as-cast alloy to obtain a further refined high-pressure solidified A356 alloy; and (5) aging the high-pressure solidified A356 alloy obtained in Step (4) at 150 to 200 DEG C for 2 to 100 h to finally obtain the A356 alloy, wherein the A356 alloy has a maximum compressive strength of 371 Mpa.

2. A preparation method of an A356 alloy, the A356 alloy being prepared from the following components in percentage by mass: 7 percent of Si, 0.35 percent of Mg, 0.05 percent of Cu, 0.08 percent of Ti, 0.3 percent of Ba, 0.6 percent of Zr, less than or equal to 0.15 percent of impurity elements and a balance Al, wherein the preparation method comprises-the following steps:

(1) taking an A356 aluminum ingot, a pure Mg ingot, an Al-Ba intermediate alloy and an Al-Zr intermediate alloy as raw materials, and calculating desired mass of each of the raw materials according to components of a target alloy;

(2) preheating the raw materials in Step (1) at 300 DEG C;

(3) setting heating temperature of a crucible resistance furnace as 720 to 780 DEG C; adding the A356 aluminum ingot when a temperature of a crucible reaches 300 to 350 DEG C; adding the Al-Ba intermediate alloy and the Al-Zr intermediate alloy in sequence when the A356 aluminum ingot is completely melted and the temperature of the crucible reaches 600 to 650 DEG C; adding a $C_2Cl_6$ refining agent after the raw materials are completely melted, and slightly stirring the mixture; removing dross from a surface of a metal melt when the temperature of the crucible resistance furnace reaches 720 to 780 DEG C, preserving the heat for 15 to 30 min, and then pouring the metal melt into a preheated metal mold to obtain a desired A356 as-cast alloy;

(4) performing high-pressure solidification on the A356 as-cast alloy obtained in Step (3): setting solidification pressure as 2 to 5 GPa, at the same time, heating the A356 as-cast alloy to 750 to 850 DEG C, preserving the heat and the pressure at this temperature for 15 to 20 min, turning off a power supply to stop heating, performing pressure relief after the A356 as-cast alloy is cooled to room temperature, and taking out the A356 as-cast alloy to obtain a further refined high-pressure solidified A356 alloy; and (5) aging the high-pressure solidified A356 alloy obtained in Step (4) at 150 to 200 DEG C for 2 to 100 h to finally obtain the high strength A356 alloy, wherein the A356 alloy has a maximum compressive strength of 371 Mpa.

* * * * *